United States Patent [19]

Jones

[11] 4,070,057

[45] Jan. 24, 1978

[54] COMBINED FOLDING TABLE AND SEAT ASSEMBLY

[75] Inventor: William C. Jones, Midland, Mich.

[73] Assignee: Franklyn M. Markus, Cote St. Luc, Canada

[21] Appl. No.: 707,111

[22] Filed: July 20, 1976

[51] Int. Cl.[2] ..... A47B 39/00

[52] U.S. Cl. ..... 297/159; 108/35; 108/112

[58] Field of Search ..... 297/159, 139, 174, 157, 297/135; 108/34–36, 38, 113, 115, 130

[56] References Cited

U.S. PATENT DOCUMENTS

| | | | |
|---|---|---|---|
| Re. 18,207 | 9/1931 | Soltesz | 108/35 X |
| 2,217,576 | 10/1940 | Weber | 297/139 |
| 2,991,829 | 7/1961 | Post | 297/139 |
| 3,099,481 | 7/1963 | Bue | 108/130 X |
| 3,143,982 | 8/1964 | Blink et al. | 108/130 X |

FOREIGN PATENT DOCUMENTS

| | | | |
|---|---|---|---|
| 69,642 | 7/1949 | Denmark | 297/139 |

*Primary Examiner*—James T. McCall

*Attorney, Agent, or Firm*—Hubbell, Cohen, Stiefel & Gross

[57] ABSTRACT

A collapsible combined table and seat assembly including an improved lightweight collapsible leg for each seat and an improved lightweight collapsible linkage for connecting the seats to the table for supporting the table in its upright condition.

21 Claims, 15 Drawing Figures

COMBINED FOLDING TABLE AND SEAT ASSEMBLY

BACKGROUND OF THE INVENTION

1. Field of the Invention

This invention relates to a combined folding table and seat assembly and particularly to a combined folding table and seat assembly that is collapsible into a self-contained carrying case comprised of the table top. Most particularly, this invention relates to a combined folding table and seat assembly which is collapsible into a case comprised of a folding table top, which assembly, when folded, is readily portable and storable in the trunk of an automobile, or a closet or the like.

2. The Prior Art

As the society has become increasingly mobile through the greatly expanded ue of the automobile, more and more families seek to picnic along the side of a road or in a secluded spot. While, often times, prepared picnic facilities are provided, these are generally crowded and are commonly located at sites that are cultivated. Many people prefer to picnic by themselves in more natural surroundings where no dining facilities are available. Also, one often finds no permanent picnic facility at the time he wishes to eat. This generally leads to the use of a picnic blanket or the like which is uncomfortable and often untidy. Thus, there is a growing need for a portable dining facility in the form of a collapsible table and chair assembly.

A similar need has arisen in schools and other public facilities such as conference rooms which are unstructured classroom arrangements. In such arrangements, it is often desirable to clear a room entirely of tables and chairs for certain school activities. To remove standard classroom desks and chairs is an impractical solution to that problem and thus a need for a collapsible chair and desk has arisen.

The need for lightweight and durable collapsible tables and chairs has been recognized for a long time. Thus, for example, in Bassford U.S. Pat. No. 1,272,187 granted on July 9, 1918, a collapsible combined table and seats is disclosed. This Bassford assembly was, by virtue of the nature of the collapsing movements of the various components, relatively large in its collapsed condition. Moreover, there are a number of detachable elements which must be disconnected before collapse is effected and must be connected when operating it to its open position. In U.S. Pat. No. 1,514,418 granted to J. N. Battenfield on Nov. 4, 1924, a combined folding table and seat is disclosed which includes a complex collapsible linkage that is necessarily of substantial weight if it is to have adequate rigidity. Moreover, during the assembly and disassembly of the Battenfield structure, a variety of elements must be disconnected from one another. In the Peterson U.S. Pat. No. 1,641,010, a collapsible table or chair or seat arrangement is disclosed. This arrangement however has a multiplicity of detached separate parts which must be joined to assemble the assembly. This is not convenient and is time consuming. Moreover, because of the number of separate joints in the Peterson device, it is difficult to make such a device rigid without utilizing heavy costly parts. Similarly, in the patent granted to L. Wing on June 11, 1929, U.S. Pat. No. 1,716,612, a collapsible combined table and seat is disclosed. However, the nature of the support of the table on the seats is such as to render the structure somewhat unstable. In Soltesz U.S. Pat. No. Re. 18,207 granted Sept. 22, 1931 still another collapsible combined table and seat is disclosed. This structure requires complex toggle linkages and numerous separate operations for assemblying and disassemblying for combined assembly. Also, the structure precludes access from the sides of the seat, thereby rendering it inconvenient in use. On Oct. 8, 1940, a patent was granted to F. Weber, U.S. Pat. No. 2,217,576, which patent is directed to a collapsible folding table and seat. This device requires complex sliding linkages which would prove to be heavy and costly. In U.S. Pat. No. 2,558,465 granted to P. M. Seymour on June 26, 1951, another combined table and bench assembly is disclosed. This table and bench assembly relies heavily on chainlike tension members for stiffness which members are heavy. Also, the nature of the assembly is such that the table in the Seymour assembly will not be as stable as is required for normal dining use. Likewise, in U.S. Pat. No. 2,647,562 granted to C. F. Hoffar on Aug. 4, 1953, a combined collapsible table and seat assembly is disclosed. However, the Hoffar structure also includes complex linkages and requires a large number of independent operations for opening and closing the assembly. In addition, the Hoffar assembly includes linkages which preclude access from the sides of the benchlike seats and thereby render the assembly difficult to use. Post U.S. Pat. No. 2,991,829 granted on July 11, 1961 likewise discloses a combined collapsible table and seats. This, again, includes complex toggle linkages and requires a variety of separate and distinct operations for opening and closing the assembly. Similar limitations exist in the structures illustrated and described in French Pat. Nos. 1,054,743 and 1,092,230. French Pat. No. 988,168 relies on a flaccid seat which is not wholly rigid in use and the support for the table top is a parallelogram which is inherently less stable than triangular supports. In U.S. Pat. No. 3,141,424 which was granted to P. M. Seymour on July 21, 1964, yet another combined table and seat assembly is disclosed. This assembly does not collapse compactly and it also includes relatively difficult to make cam tracks in its linkage. Finally, in U.S. Pat. No. 3,256,037 granted to J. Giambaldo on June 14, 1966, yet another form of combined table and seat is disclosed. This structure is inconveniently heavy and the linkage employed therein will not yield as rigid a structure as is required.

Recently, U.S. patent application Ser. Nos. 625,695, 683,327 and 693,341 filed respectively on Oct. 24, 1975, May 5, 1976 and June 7, 1976 were directed to new and improved collapsible combined table and seat assemblies. The contents of these applications are hereby incorporated by reference in their entireties. While these applications are directed to subject matter which is believed to represent significant advances in the art, nevertheless, it is a goal of the present invention to produce such an assembly with the utmost of simplicity of construction, light weight and great rigidity during use.

From the review of the prior art above presented, it will be seen that there have been numerous attempts over many years to produce a light weight, easily folded and unfolded, rigid combined collapsible table and seats. However, each prior art proposal has fallen somewhat short of the mark. As a result, there has been no significant commercial success for any of the prior art devices known to the applicant.

DETAILED DESCRIPTION OF THE PREFERRED EMBODIMENT

Figure 1:
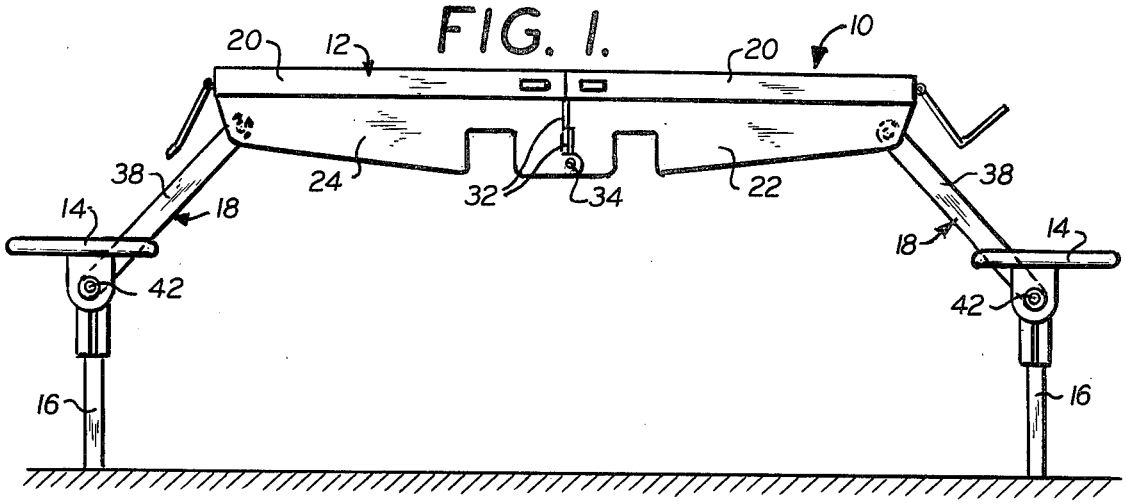
FIG. 1 is a side elevational view of a combined collapsible table and seats assembly embodying the present invention in condition for use.
Figure 2:
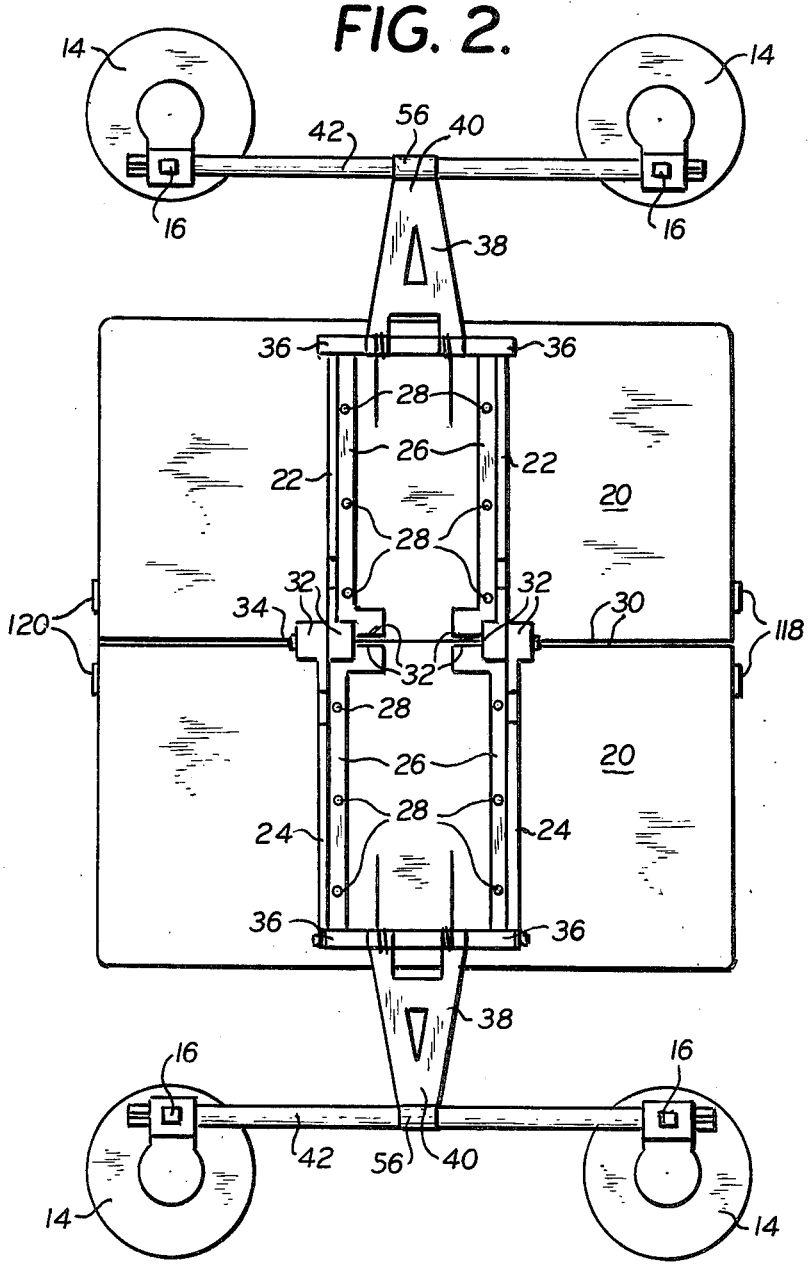
FIG. 2 is a bottom plan view thereof.

Referring now to the drawings in detail and especially to FIGS. 1 and 2 thereof, a collapsible combined table and seat assembly embodying the present invention is generally designated by the reference numeral 10 and includes a table 12, seats 14, supporting legs 16 for said seats, and a collapsible linkage 18 extending between the seats and the table 12 for supporting the table in the open condition shown in FIG. 1.

As shown, the table 12 actually preferably comprises a pair of complementary table top halves 20 which may be made of any suitable material, preferably a light weight material such as wood, sheet metal such as sheet aluminum, fiberglass-reinforced plastic or the like. Most preferably, the material is very light weight and to this end composite structures such as honeycomb cores may be employed. Among materials which may be useful for forming the table top halves 20 are materials formed by foam injection molding. Such materials may be polystyrene, polycarbonate, polyvinylchloride, low molecular weight polyethylene, polypropylene, or other similar material capable of being employed for structural foam injection molding. Such materials and the process of foam injection molding are described in the following U.S. Patents, the contents of which are hereby incorporated by reference in their entireties: U.S. Pat. Nos. 3,058,161; 3,211,605; 3,268,636; 3,384,691; 3,436,446; 3,599,290; 3,674,401; and 3,746,492.

Figure 6:
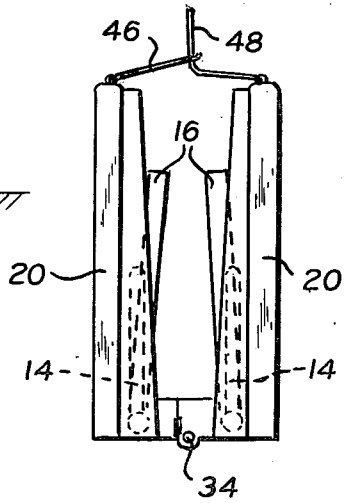
FIG. 6 is a side elevational view of a fully collapsed assembly.

Secured to the bottom of each table top half 20 along a central portion thereof are a pair of reinforcing members 22 and 24 which are preferably provided with flanges 26 that abut the bottom surface of the table top members 22 to provide securement thereto as by securing elements such as screws 28. The flanges are inwardly directly toward one another at the confronting edges 30 of the table top halves 20 and are provided with vertically extending portions 32 at that location to provide for abutment when the table is in an extended or open position as shown in FIGS. 1 and 2 to limit the amount of relative rotation between the two as will be understood more clearly hereinafter. Also provided near the edges 30 on each of the supporting members 22 and 24 are apertured bosses 32 which are in offset alignment with one another with their apertures in register. It will be seen especially from FIG. 2 that the support members 24 and 22 must be offset from one another in order to effect the alignment of the bosses 32 as just described. A suitable pivot member 34 extends through the registered apertures in the bosses 32 whereby to pivot the two table top portions 20 to one another for relative pivotal movement between a coplanar position as shown in FIG. 2 and a spaced apart confronting relation as shown in FIG. 6.

At the outer end of each of the members 22 and 24 are additional apertured bosses 36, the apertures of which are in alignment. These apertured bosses 36 provide a means for pivotally connecting the outer ends of the table top members 20 to tapered support brackets 38 which constitute the principal member of linkages 18. The details of the pivotal connections between the bosses 36 and the bracket 38 will be described in greater detail hereinafter. The narrow ends of the support brackets 38, that is the ends 40, are also provided with bearings for pivotally mounting the brackets 38 on cross-pieces 42 that serve as supports for the seats 14. As will be more fully understood hereinafter, seats 14 are preferably non-rotatable relative to the cross-pieces 42, although such pivotal movement could be permitted if desired. The manner of effecting the non-rotation will be described in greater detail hereinafter.

Extending downwardly from the cross-pieces 42 adjacent each end thereof are legs 16 which legs are preferably mounted for pivotal movement relative to the cross-pieces 42 in a manner which will be described hereinafter. Such description will also establish that the legs 16 may be releasably held in the vertical position shown in FIG. 1 by means to be described subsequently. While the legs are shown in FIG. 1 to be vertically directed, it will be understood that they need not be precisely plumb and it may be desired to have them be at a slight angle to the vertical in actual construction. However, at present, the vertical orientation is preferred. As may best be seen in FIG. 2, the legs 16 are disposed immediately beneath each seat. However they are not shown aligned with the center of seats 14 but, instead are aligned forwardly of said centers. While this presently preferred, it is within the contemplation of this invention that the legs be in alignment in their extended position with other points on seats 14, such as, for example, the centers of the seats.

The table as shown in FIG. 1 is in its open condition and to hold it in that condition a suitable stop means to be described hereinafter is included for preventing pivotal movement of the brackets 38 relative to the table tops portions 20 beyond the position shown in FIG. 1. As already noted, downturned portions 32 of the flanges 26 abut one another when the table top portions 20 are coplanar, whereby to prevent further pivotal movement of those two members relative to one another. Also, as noted, means are included for releasably holding the legs 16 in the vertical position shown in FIG. 1. Thus a completely rigid structure is shown in its open condition in FIGS. 1 and 2.

Figure 3:
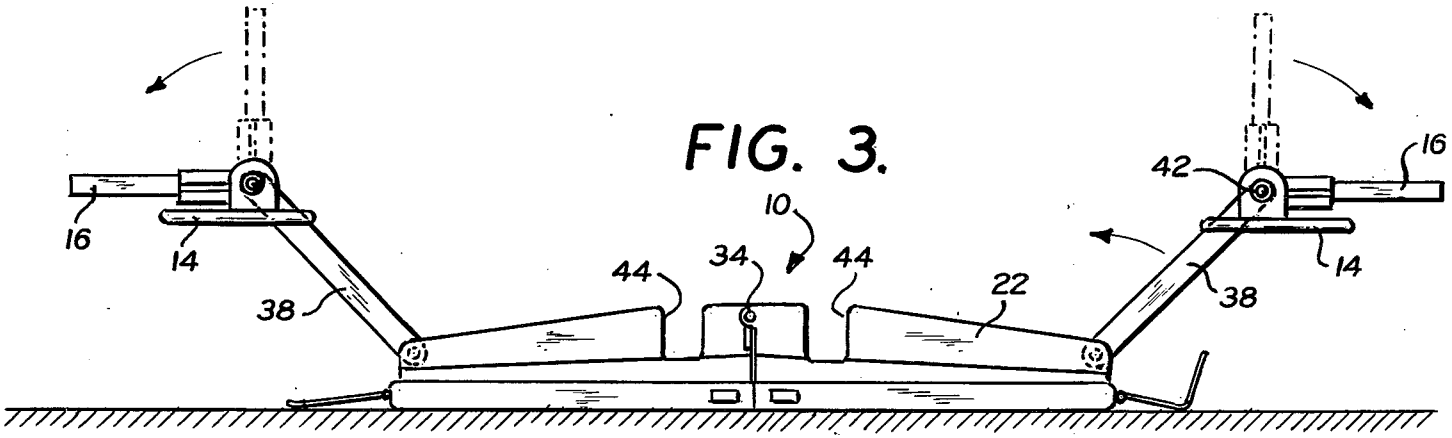
FIG. 3 is a view similar to FIG. 1 but showing the assembly upside down and in a partially collapsed condition.
Figure 4:
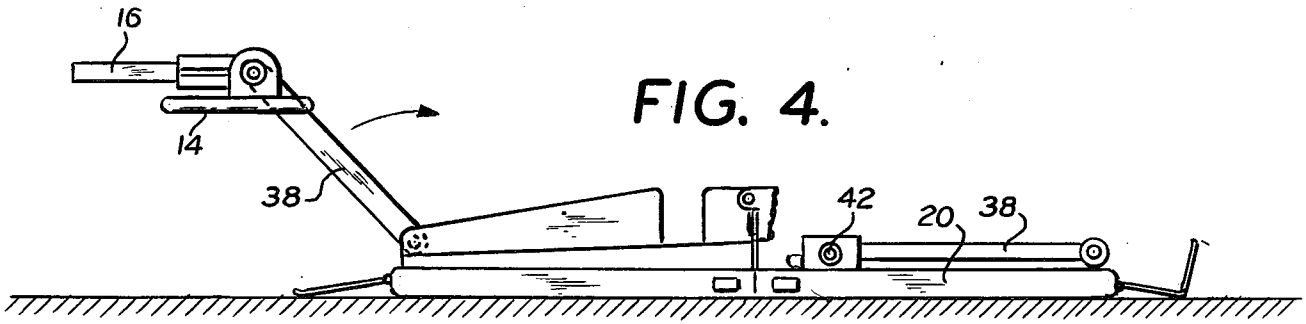
FIG. 4 is a view similar to FIG. 3, with certain parts broken away to more clearly illustrate others, showing the assembly in still a further stage of collapse.
Figure 5:
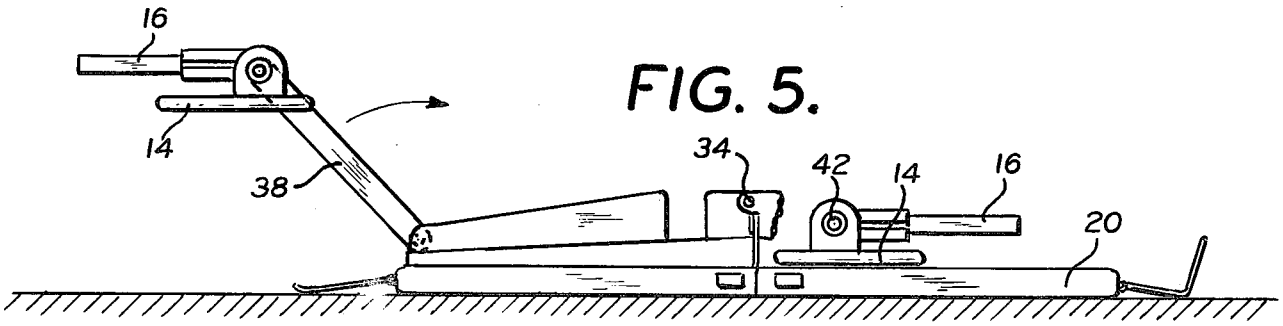
FIG. 5 is a view similar to FIG. 4 with other parts deleted in order to more clearly illustrate parts not seen in FIG. 4 and showing the same state of collapse as that shown in FIG. 4.

Generally speaking, to collapse the assembly 10 it is best to first turn it upside down as shown in FIG. 3. In that position, the means for releasably holding the legs 16 in their vertical position can be easily released and the legs can be pivoted from the dotted line or vertical position shown in FIG. 3 to the solid line or horizontal position shown in that Figure. In that condition, the legs 16 and their corresponding seats 14 are in parallel planes. Once the condition of FIG. 3 is achieved, one of the brackets 38, for example the right hand bracket 38 shown in FIG. 3, may be pivoted in the direction of the arrow associated therewith, that is the counter-clockwise direction, to move the bracket 38 into horizontal position in which position the cross members 42 will fit into the notches or cutouts 44 in the stiffening members 22. In that position, shown in FIG. 4, the center bracket 38 will lie substantially parallel to its corresponding tabletop half 20 and between members 22. Similarly, as shown in FIG. 5, the seats 14 which are offset from the bracket 38 will rest substantially against the bottom surface of the table top portion 20 and outward of the adjacent stiffening member with the legs 16 lying thereover in spaced relation with said bottom surface. After the right portion of the assembly has been so collapsed, identical collapse can be effected on the left hand portion by pivoting the bracket on the left hand in a clockwise direction as indicated by the arrow in FIGS. 4 and 5 to bring the left hand bracket and its seats 14 and legs 16 into an identical (mirror image) orientation as that already described with respect to the right hand portion of the assembly. Thereafter, the two table top halves 20 can be pivoted about the pivot 34 to bring the table top halves into spaced apart confronting relation with the remainder of the assembly therebetween, whereby to provide for the table top portions as a case for the remainder of the collapsed assembly 10. A suitable means is provided for holding the collapsed assembly in FIG. 6 in the illustrated position and for carrying the assembly which means are shown here to be two flaccid loops 46 and 48, one secured to the outer end of each of the table top portions 20 which loops can be slipped through one another to serve as a handle and as a means for holding the entire assembly in the collapsed condition shown in FIG. 6.

Clearly, a reverse series of steps may be followed to open the assembly from the closed condition shown in FIG. 6 to the open condition shown in FIG. 1.

Figures 7, 8, 9, 10, 11:
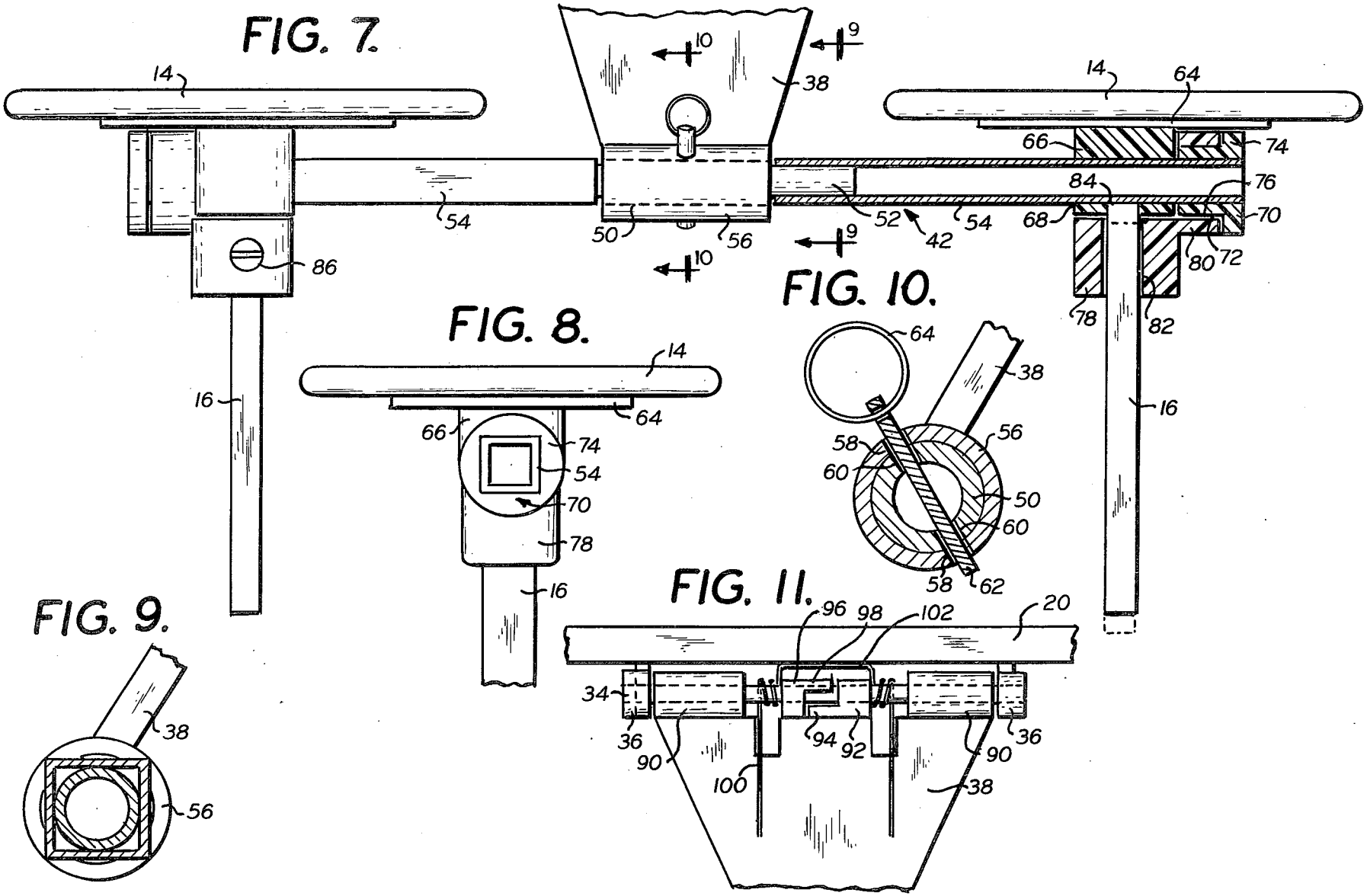
FIG. 7 is a fragmentary end view partly in elevation and Partly in section showing the presently preferred mechanisms for supporting the seats and legs.
FIG. 8 is an end elevational view looking from the right of FIG. 7.
FIG. 9 is a sectional view taken along the line 9—9 in FIG. 7.
FIG. 10 is a sectional view taken along the line 10—10 in FIG. 7.
FIG. 11 is a fragmentary end elevational view of the assembly showing the means for pivotally mounting the table support member to the table top.

FIG. 7 illustrates the presently preferred means for pivotally mounting the bracket 38 on the cross-piece 42, and for pivotally mounting the legs 16 on said cross-piece and for fixedly holding the seats 14 on said cross-piece. As may be seen in FIG. 7, the cross-piece is not in its preferred form a single or unitary member but is in fact made up of three separate members that are joined together as by pressed fitting, screws, welding or the like. Specifically, cross-piece 42 comprises a central tubular member 50 which is cylindrical in shape and is provided with two outwardly extending end portions 52 (only one of which may be seen in FIG. 7) which are also cylindrical but of reduced diameter. Fixedly secured to the outwardly extending portions 52 as by press fitting, securing elements, adhesive, welding or the like are a pair of tubular members, preferably non-circular, here shown to be square, which tubular members are designated by the reference character 54. The bottom or narrow end of the bracket 38 is provided with a cylindrical bearing 56, which is preferably an integral apertured boss that is disposed about the central cylindrical portion of the member 50 for rotation relative thereto. As may be seen best in FIG. 10, the bearing member 56 on the bottom of the bracket 38 and the central portion of the member 50 are provided with through holes 58 and 60 respectively which are aligned when the bracket 38 is in its open position relative to its associated table top 20. With the apertures 58 and 60 so aligned, a holding pin 62 having a finger ring 64 at one end thereof may be inserted through the aligned holes 58 and 60 to hold the bracket 38 against pivotal movement relative to the cross-piece 42. When it is desired to permit such rotation, the pin 62 is removed by grasping the finger ring 64 and pulling the pin out of the aligned holes.

As noted, the outer portions 54 of the cross-piece 42 are square in cross-section. It is this non-circular configuration which serves to hold the seats 14 against rotation relative to the cross-piece 42 as will be described. Still with reference to FIG. 7, the seats 14 are preferably foam injection molded parts preferably made of materials essentially identical to that of the table top 20 as has been described. As shown, the seats are round, although other configurations may be employed.

Underlying each of the seats 14 and formed preferably integrally therewith, is a round stiffening portion 64 from which depends a boss 66 preferably formed integrally with the seat 14 and the stiffening member 64 as during injection molding which boss has a through hole of cross-section that is complimentary to the cross-section of the end portion 54 of cross-piece 42, that is square as shown in the drawings. Preferably the through-hole 68 is proportioned so that the boss 66 can be press-fitted onto the member 54 and held by friction. Of course, other means for securing that member to the cross-piece may be employed without departing from the present invention.

It will be seen, however, that by virtue of the noncircularity of the hole 68 and the end portion 54 of cross-piece 42, seat 14 is fixed against rotation relative to the cross-piece 42. Press-fitted onto the very end of the square end-pieces 54 of cross-piece 42 are bushings 70 having a cylindrical main body portion 72 and a flanged end 74 with a throughhole 76 of cross-section complementary to the cross-section of end portion 54 of cross-piece 42, here shown to be square. Again, the through-hole 76 is preferably proportioned to provide for a pressed fit of the bushing 70 on the end of the end portion 54. Naturally other means of supporting the bushing in its fixed position may be employed. As will be seen, the bushing 70 will provide a pivot bearing for the legs 16. Thus, it is preferably made of a material of relatively low coefficient of friction such as for instance delryn or nylon or polytetrafluorethylene or the like, although many other suitable materials may be employed therefor.

As already noted, the leg 16 is pivotally mounted on the cylindrical portion 72 of the bushing 70. This pivotal mounting is accomplished through the means of a mounting block 78 which is integral with and depends from a sleeve portion 80, the inner diameter of which is proportioned to rotatably encircle the cylindrical portion 72 of bushing 70. Mounting block 78 is provided with a vertical aperture 82 of cross-section complementary to the cross-section of the legs 16. As presently preferred, for strength, the legs 16 are of a square configuration and may be made of square aluminum tubing or the like although many other materials may be employed. In addition, it will be obvious that the legs could be of other cross-sectional shapes such as, for example, round. The through-hole 82 in the mounting block 78 is proportioned to permit the legs 16 to slide therein with a close fit. Mounting block 78 may be made of any suitable material but is presently preferred to be made of injection molded plastic, preferably of good strength and low coefficient of friction.

Provided in the bottom of the boss 66 is an indentation or a hole 84 which registers with the hole 82 in the block 78 when the leg 16 is in its vertical or extended position. In that position, the leg may be slid upwardly into the hole 84 in the boss 66 whereby to lock the leg against pivotal movement. To control the sliding movement of the leg 16 and thus avoid accidental removal thereof from its mounting block 78 a friction stop 86 may be force-fitted or threadedly mounted in the mounting block 82 with its inner end (not shown) in engagement with one of the faces of each of the legs 16 to require positive force to move the leg between its solid and dotted line position as shown in FIG. 7.

Figure 15:
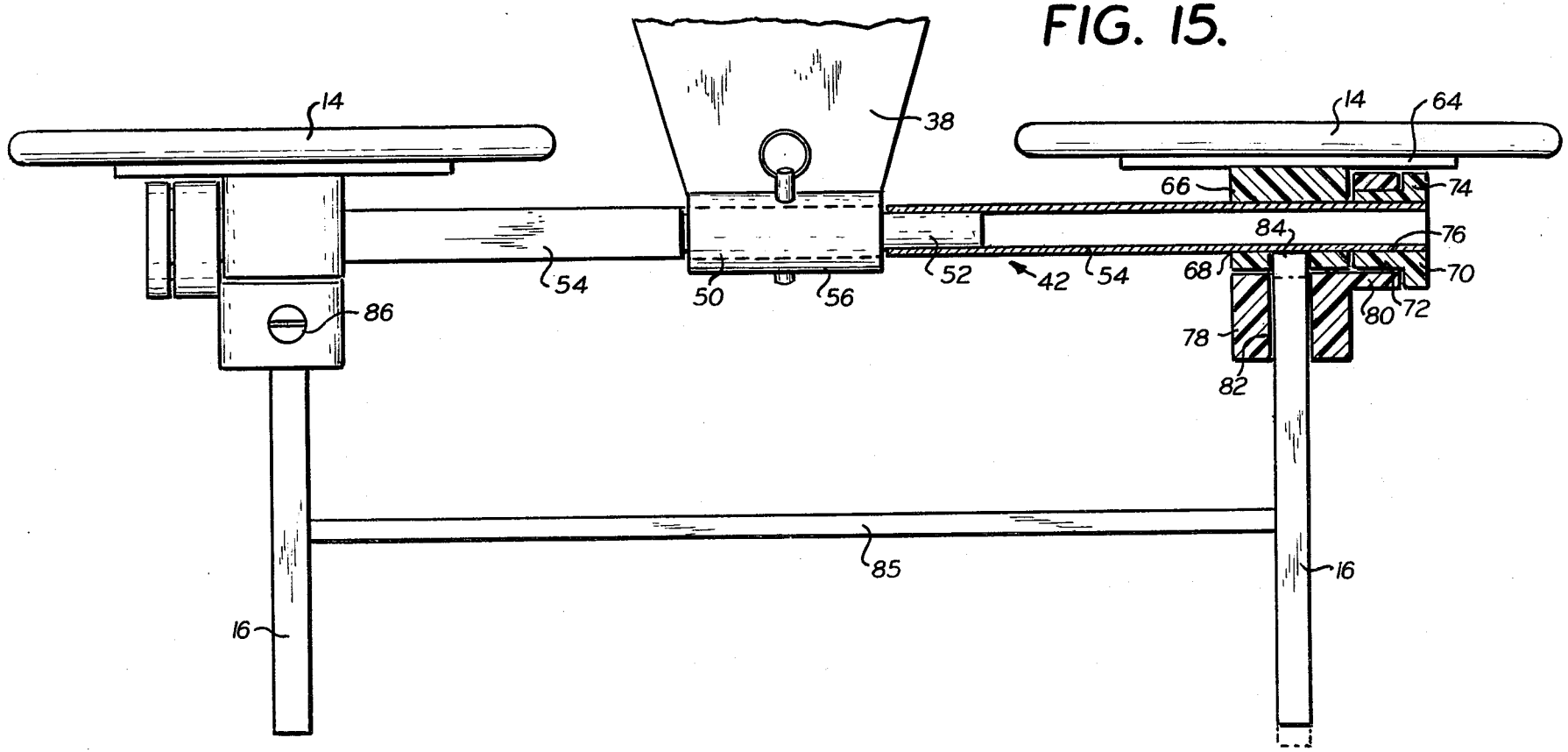
FIG. 15 is a view similar to FIG. 7 showing yet another modication.

With the arrangement as described, and commencing with the leg 16 in its extended and secured solid line position, if it is desired to move the leg to its folded position, it is first grasped and slid downwardly a short distance to the dotted line position shown in connection with the right leg in FIG. 7 whereby to clear the aperture 84 in boss 66 and free the leg for pivotal movement. The leg may then be swung from the vertical to the horizontal position by virtue of the rotation of sleeve 80 on the bushing 70. In this connection, it will be noted that in FIG. 7 the legs 16 pivot independently of one another. While such an arrangement is eminently satisfactory, if it is desired to further simplify the folding and unfolding of the assembly 10, the mounting blocks 78 on each side of the table and seat assembly may be connected together by any suitable member whereby once the legs 16 are freed from the bosses 66, then rotation of one will result in rotation of both. Clearly, any suitable cross-piece between the companion mounting blocks 78 will accomplish this. Moreover, if it is desired a rigid cross member may be provided between the legs 16 whereby they may be moved in unison longitudinally to free them from their respective apertures 84 and then the cross-piece or either of the legs 16 may be grasped to pivot both legs in unison to the horizontal position. This modification is illustrated in FIG. 15 wherein the cross member is designated by the numeral 85.

The upper end of the bracket 38 has previously been described as mounted on the bottom of table top half 20, particularly between a pair of aligned apertured bushings 36 at the ends of bracing members 22 or 24. In FIG. 11, the preferred means for accomplishing this mounting is illustrated. Referring now to FIG. 11, the member 38 which may be made of plastic or metal or any other suitable material is esentially flat although reinforcing ribs may be provided and, as shown in FIG. 2, cutouts may be included for reducing weight. At the upper end of the bracket 38 at opposite sides thereof are a pair of apertured bushings 90 in alignment with the apertured bushings 36. Close to the center of the upper edge of the member 38, there is fixed yet another bushing 92 in alignment with the bushings 90 which bushing 92 has a longitudinally extending projection 94 which, as will be understood hereinafter, serves as a stop member. Extending through the aligned bushings 36, 90 and 92, is pivot pin 34. Press-fitted onto the pivot pin during its insertion through the aligned bushings 36 and 90 is a second stop member 96 having a longitudinal protrusion 98. The bushing 96 is fixed against rotation relative to the pin 34 and therefore pivots relative to the bushing 92 when the member 38 is pivoted about the pin 34. The stop members are angularly located so that when the member 38 is moved from its folded position shown, for example, in FIG. 4, to its open position shown, for example, in FIG. 1, the two stop members or protrusions 94 and 98 pivot relative to one another until they come into engagement with one another whereby to prevent further pivotal movement between the member 38 and the table top 20.

With further reference to FIG. 11, it will be seen that it is preferred to mount about the pivot pin 34 a U-shaped biasing spring 100, having its free ends in engagement with the bracket 38 and the bight 102 in engagement with the under-surface of the table top portion 20. Spring 100 will therefor bias the member 38 towards its open position so that when the assembly pin is unfolded from its closed position shown in FIG. 6 to the position of FIGS. 4 & 5, the members 38 will automatically swing to their open position to facilitate the opening of the assembly. Clearly, if the spring is included in the assembly, which is presently preferred, during the closing operation the user must press the members 38 down against the bias of the springs to bring them into parallel planar relation with the table top portion 20.

Figures 12, 13, 14:
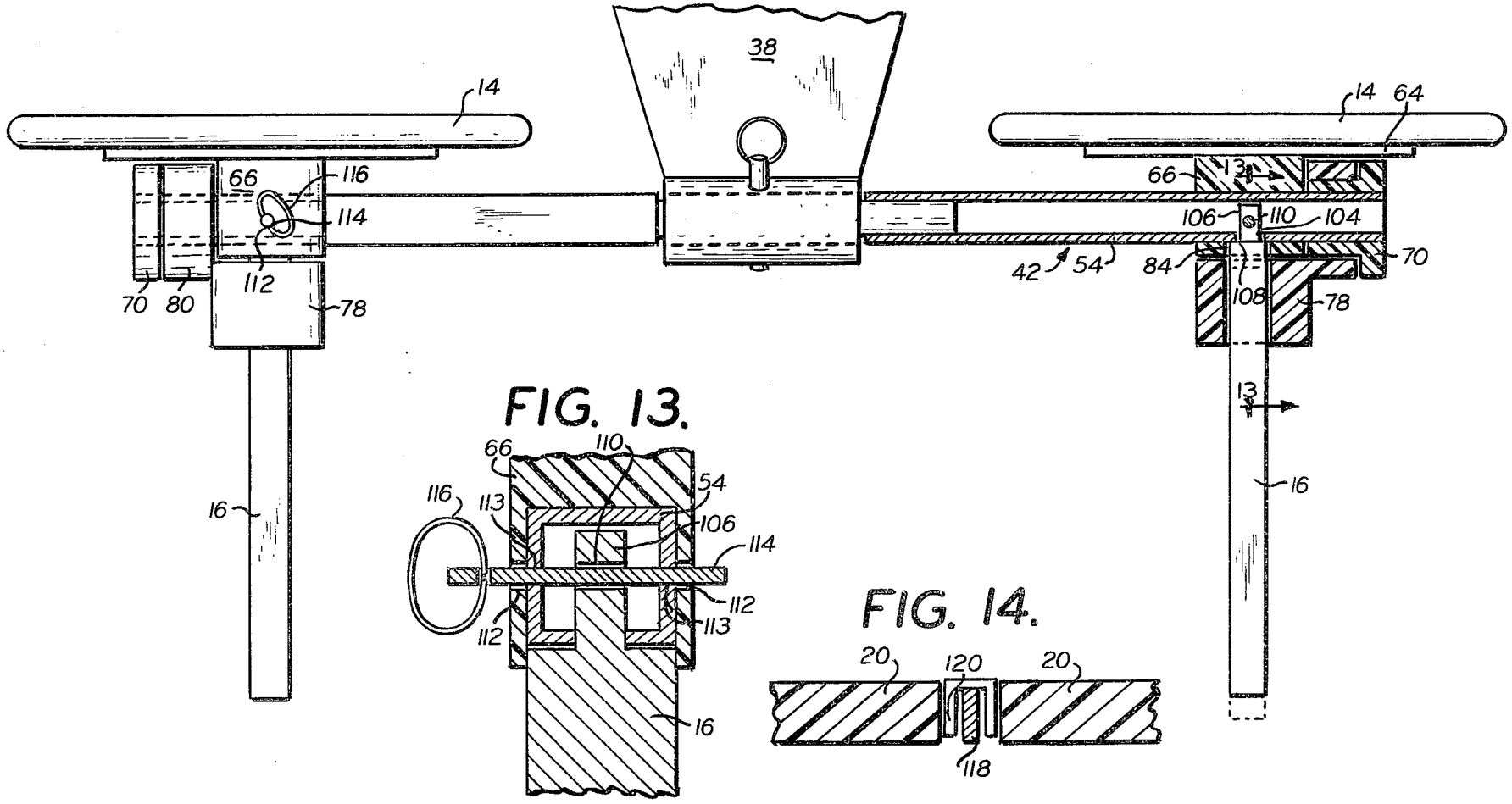
FIG. 12 is a view similar to FIG. 7 but showing a modified means for holding the legs.
FIG. 13 is a fragmentary sectional view taken along the line 13—13 in FIG. 12 with certain parts deleted to more clearly illustrate other parts of the invention.
FIG. 14 is a fragmentary sectional view illustrating an optional feature of my invention.

Referring now to FIG. 12, a modified form of means for supporting and holding legs 16 in their respective mounting blocks 78 is shown. The mounting block is in all respects identical to the mounting block of FIG. 7. This is also true of the bushing 70. However, to provide for additional security of connection of the leg 16 is its unfolded position, in addition to the alignable aperture 84 in the bottom of the boss 66, the square end member 54 of the cross-piece 42 is provided a hole 104 in register with the hole 84 and hence registrable the leg 16 in its unfolded position. The upper end of the leg 16 is provided with a pin 106 which may pass through the hole and into the interior of the square end-piece 54 until the shoulder 108 defined by the upper end of the square portion of the leg 16 comes to rest against the bottom of the cross-piece 54. A transverse hole 110 is provided in the pin 106 and when the leg is fully inserted as shown in FIG. 12, that hole 110 is in register with a through hole 112 in boss 66 and with aligned through hole 113 in the two sides of the member 54. Thus a pin 114 having a finger ring 116 may be inserted through the aligned holes 110, 112 and 113 to thus releasably lock the legs 16 in their vertical or open position. Obviously, in lieu of the pin 112, a suitable spring-press detent could be employed for this purpose.

It will be obvious to anyone skilled in the art that the various components heretofore described may be made out of a large variety of suitable materials. Some of these materials have already been described in some detail. However, for example, the legs 16 can be made of wood, plastic, fiberglass-reinforced plastic, or metal. The legs have been described as tubular, although, of course, they could be solid. A preferred material is aluminum, although magnesium would be eminently satisfactory. A number of plastics would also serve well. The various components of the cross-piece 42 are ilustrated by virtue of cross-hatching as being metal and the preferred metals are aluminum or magnesium. However, the cross-piece could be made of plastic or any other suitable material. The choice of other materials employed herein is well within the ability of the skilled art worker and any description thereof is deemed to be unnecessary.

The assembly 10 illustrated and described is shown with a pair of seats 14 on each side of the centrally foldable table 12. As is described in some detail in the aforementioned three earlier applications of Edwin Nikitits and Jean Guy Demers, the contents of all of which are hereby incorporated by reference, other seating arrangements may be employed without departing from this invention. Thus, for example, an assembly may be arranged with one seat 14 on each side or three seats 14 on each side. The alterations in the described construction for effecting this change are well within the ability of the skilled art worker and well within the contemplation of this invention, especially after reference to said earlier applications. If desired, the table may be arranged so that the table top is not collapsible and only one seat is provided on one side, a suitable collapsible leg being provided on the other side to support such an assembly. This is described in some detail in the aforementioned Nikitits and Demers applications and an adaptation of those structures to this particular design is well within the ability of the person of ordinary skill. Similarly, any of the seating arrangements, that is an assembly with one seat, two seats or three seats, for example, can be arranged so that instead of pivotally mounting a table top portion 20 on opposed table top portion, as is shown herein, one single table top portion 20 could be pivotally mounted on a wall or partition or some other vertical member so that it may be folded out when desired for use and may be put away against the wall when additional space is required in the room.

The various assemblies described herein have numerous uses. In addition to serving as a portable picnic table and seats which may be carried in the trunk of an automobile, these assemblies would be extremely useful in homes, offices, schools, auditoriums or the like. When used in large arrays such as in auditoriums or gymnasiums or the like, it may be desirable to prevent relative movement between adjacent assemblies 10. This may be accomplished by incorporating means for releasably connecting adjacent assemblies to one another whereby to hold them releasably fixed relative to one another when in use. Any suitable means for effecting such a detachable connection may be employed. As illustrated in the drawings and especially in FIG. 14, a suitable metal U-shaped strap (here shown as two) may be secured to one side of the table, which straps are designated the reference numeral 118 and a U-shaped finger 120 may be secured to the opposing side of the adjacent table, the fingers 120 being insertable in the spaces between the straps 118 and the edge of the adjacent table top 20 whereby to hold the two together. Such means are also illustrated in a number of the other drawings shown herein. Obviously other suitable means for releasably holding adjacent assemblies fixed relative to one another may readily suggest themselves to those skilled in the art.

An additional use to which assembly 10 or its variations here and before described may be put is in miniaturized furniture for children or for dolls. Clearly, the invention is not limited to an assembly of any particular size and such miniaturized assemblies are within the scope and contemplation of this invention.

While I have herein shown and described the preferred form of this invention and have suggested modifications therein, other changes and modifications may be made therein within the scope of the apppended claims without departing from the spirit and scope of this invention.

I claim:

1. In a collapsible combined table and seat assembly of the type comprising a table, a seat disposable adjacent one end of and below the plane of said table, and leg means, wherein the improvement comprises:

a cross-piece non-rotatably fixed to and supporting said seat;

a bracket pivotally mounted at one end to said table for movement between an open position in which said bracket extends downwardly away from said table and a closed position in which said bracket is in close confronting relation with said table;

means for preventing pivotal movement of said bracket away from said closed position beyond said open position thereof;

said cross-piece being pivotally mounted on the other end of said bracket, whereby said seat can be moved into close confronting relation with said table upon the movement of said bracket between its open and closed position without pivoting said seat relative to said cross-piece;

means for pivotally mounting said leg means on said cross-piece for movement about the longitudinal axis of said cross-piece between an open position in which said leg means extends downwardly from said cross-piece and a closed position in which said leg means is in a plane substantially parallel to the plane of said seat; and means for releasably holding said leg means in said open position, whereby said one end of said table is supported in an elevated position when said leg means and said bracket are in their respective open positions.

2. The collapsible combined table and seat of claim 1, further comprising means connected to said other end of said table for suporting said other end of said table in an elevated position.

3. The collapsible combined table and seat of claim 2, wherein said means for supporting said other end comprises another seat, another leg means, another cross-piece and another bracket all connected to each other and to the other end of said table in the same manner that the corresponding elements are connected to each other and to said one end of the table as defined in claim 1.

4. The collapsible combined table and seat of claim 3, wherein said table comprises a pair of table top portions pivotally connected to one another for movement about an axis extending substantially parallel to said two table ends.

5. The collapsible combined table and seat of claim 1, wherein said cross-piece is non-rotatably fixed to said seat by including in said cross-piece a non-circular portion, said seat having a dependent boss with a non-circular aperture therein, said non-circular portion of said cross-piece extending through said non-circular boss aperture.

6. The collapsible combined table and seat of claim 5, wherein said leg means includes an elongated leg, and wherein said means for pivotally mounting said leg means includes a bushing having a cylindrical outer surface and an axially extending non-circular aperture through which said non-circular portion of said cross-piece extends, a mounting block comprising a cylindrical sleeve rotatably disposed about the outer surface of said bushing whereby to pivotally mount said block on said cross-piece, said block further including a body portion having an aperture extending away from said cross-piece, said leg being disposed in said body portion aperture.

7. The collapsible combined table and seat of claim 6, wherein said means for releasably holding said leg comprises a boss depending from said seat, said boss being provided with an aperture which is registrable with said leg when said leg is in the open position, said leg being longitudinally movable into and out of said last-mentioned boss aperture, whereby to respectively lock said leg against and unlock said leg for pivotal movement relative to said cross-piece.

8. The collapsible combined table and seat of claim 4, wherein each of said cross-pieces is non-rotatably fixed to its associated seat by including in said cross-piece a non-circular portion, each seat having a dependent boss with a non-circular aperture therein, said non-circular portion of each cross-piece extending through said non-circular aperture in the boss of the associated seat, and wherein said leg means includes an elongated leg for each cross-piece, and wherein said means for pivotally mounting each leg means includes a bushing having a cylindrical outer surface and an axially extending non-circular aperture through which said non-circular portion of the associated cross-piece extends, a mounting block for each bushing comprising a cylindrical sleeve rotatably disposed about the outer surface of each bushing, whereby to pivotally mount said block on said cross-piece, each block further including a body portion having an aperture extending away from its associated cross-piece, each leg being disposed in the aperture of its associated body portion; and wherein said means for releasably holding each said leg comprises the boss of the associated seat having another aperture which is registrable with said leg when said leg is in the open position, said leg being longitudinally movable into and out of said last-mentioned boss aperture, whereby to respectively lock said leg against and unlock said leg for pivotal movement relative to said cross-piece.

9. The collapsible combined table and seat of claim 6, wherein the longitudinal axis of said leg intersects said seat when said leg is in its open position.

10. The collapsible combined table and seat of claim 8, wherein the longitudinal axis of said leg intersects said seat when said leg is in its open position.

11. The collapsible combined table and seat of claim 1, wherein said cross-piece supports a pair of spaced apart seats, said bracket is secured to said cross-piece between said seats, and said leg means comprises a pair of spaced apart legs, each underlying one of said seats when said legs are in their open positions.

12. The collapsible combined table and seat of claim 11, wherein said cross-piece includes a circular central portion pivotally connected to said bracket, and a pair of non-circular end portions, each of said seats including a dependent boss having a non-circular aperture therein through which one of the non-circular portions of said cross-piece extends to prevent relative rotation between said seats and said cross-piece.

13. The collapsible combined table and seat of claim 12, wherein the means for pivotally mounting each leg includes a bushing having a cylindrical outer surface and an axially extending non-circular aperture through which one of said non-circular portions of said cross-piece extends, a mounting block comprising a cylindrical sleeve rotatably disposed about the outer surface of said bushing, whereby to pivotally mount said block on said cross-piece, said block further including a body portion having an aperture extending away from said cross-piece, said leg being disposed in said body portion aperture.

14. The collapsible combined table and seat of claim 13, wherein said means for releasably holding said leg means comprises means for releasably holding each of said legs, said leg holding means each comprising the dependent boss on the seat associated with each leg, said dependent boss having an aperture which is registrable with said leg when said leg is in the open position, said leg being longitudinally movable into and out of said last-mentioned boss aperture, whereby to respectively lock said leg against and unlock said leg for pivotal movement relative to said cross-piece.

15. The collapsible combined table and seat of claim 14, further comprising means for operatively connecting the body portions of said mounting blocks to one another to pivot said mounting blocks in unison.

16. The collapsible combined table and seat of claim 15, wherein said means for operatively connecting said mounting blocks is a rod connecting said legs, whereby said legs are moved longitudinally and are pivoted in unison.

17. The collapsible combined table and seat of claim 14, further comprising means connected to said other end of said table for supporting said other end of said table in an elevated position, and said last-mentioned means comprises another bracket, another cross-piece, another pair of seats and another pair of spaced apart legs all connected to each other and to the other end of said table in the manner that the corresponding elements are connected to each other and to said one end of the table as defined in claim 14.

18. The collapsible combined table and seat of claim 15, further comprising means connected to said other end of said table for supporting said other end of said table in an elevated position, and said last-mentioned means comprises another bracket, another cross-piece, another pair of seats and another pair of spaced apart legs all connected to each other and to the other end of said table in the manner that the corresponding elements are connected to each other and to said one end of the table as defined in claim 15.

19. The collapsible combined table and seat of claim 16, further comprising means connected to said other end of said table for supporting said other end of said table in an elevated position, and said last-mentioned means comprises another bracket, another cross-piece, another pair of seats and another pair of spaced apart legs all connected to each other and to the other end of said table in the manner that the corresponding elements are connected to each other and to said one end of the table as defined in claim 16.

20. The collapsible combined table and seat of claim 19, wherein said table comprises two pivotally connected table top portions.

21. The collapsible combined table and seat of claim 7, wherein the top of said leg is provided with a longitudinally extending apertured pin, and the cross-piece is provided with an aperture for receiving said pin when said leg is moved into said boss aperture, said cross-piece further having a pair of aligned transverse holes registrable with the aperture in said pin when said leg is in said boss aperture, and a locking pin reversably insertable through the registered transverse holes in said cross-piece and the aperture in said leg pin for releasably holding said leg.

* * * * *